US008739504B2

(12) United States Patent
Willey

(10) Patent No.: US 8,739,504 B2
(45) Date of Patent: Jun. 3, 2014

(54) PACKAGING METHOD AND APPARATUS

(75) Inventor: Jason Willey, Barry (GB)

(73) Assignee: Cadbury Holdings Limited, Uxbridge (GB)

( * ) Notice: Subject to any disclaimer, the term of this patent is extended or adjusted under 35 U.S.C. 154(b) by 590 days.

(21) Appl. No.: 13/122,174

(22) PCT Filed: Oct. 1, 2009

(86) PCT No.: PCT/GB2009/002335

§ 371 (c)(1),
(2), (4) Date: Jun. 16, 2011

(87) PCT Pub. No.: WO2010/040984

PCT Pub. Date: Apr. 15, 2010

(65) Prior Publication Data

US 2011/0239592 A1 Oct. 6, 2011

(30) Foreign Application Priority Data

Oct. 7, 2008 (GB) ..... 0818312.1

(51) Int. Cl.
*B65B 9/00* (2006.01)
*B65B 51/30* (2006.01)

(52) U.S. Cl.
USPC ..... 53/451; 53/413; 53/134.1; 53/551

(58) Field of Classification Search
USPC ..... 53/413, 451, 134.1, 551
See application file for complete search history.

(56) References Cited

U.S. PATENT DOCUMENTS

| | | | | |
|---|---|---|---|---|
| 3,568,576 | A * | 3/1971 | Lehmacher et al. | 493/194 |
| 3,803,990 | A * | 4/1974 | Pedersen | 493/224 |
| 6,574,942 | B1 | 6/2003 | Heimann et al. | |
| 2003/0179957 | A1 | 9/2003 | Tankersley | |
| 2003/0192288 | A1 | 10/2003 | Heimann et al. | |

FOREIGN PATENT DOCUMENTS

| | | |
|---|---|---|
| DE | 2 130 133 | 12/1972 |
| EP | 1 588 950 A1 | 10/2005 |
| FR | 2159659 | 6/1973 |
| GB | 2 273 287 A | 6/1994 |

OTHER PUBLICATIONS

International Search Report, International Application No. PCT/GB2009/002335.
Search Report, GB Application No. GB0818312.1.

* cited by examiner

*Primary Examiner* — Hemant M Desai
(74) *Attorney, Agent, or Firm* — Hoffmann & Baron, LLP

(57) ABSTRACT

A packaging method comprises dispensing a material continuously from a roll, forming a plurality of packages from the material, filling each package with contents and sealing each package once filled. A hanging aperture is created for each package, prior to it being formed into the package, the material having been folded or creased in the area in which the aperture is to be created.

21 Claims, 3 Drawing Sheets

PACKAGING METHOD AND APPARATUS

CROSS-REFERENCE TO RELATED APPLICATIONS

This application is the National Stage of International Application No. PCT/GB2009/002335, which designates the U.S., filed Oct. 1, 2009, which claims the benefit of GB 0818312.1, filed Oct. 7, 2008, the contents of which are incorporated by reference herein.

FIELD OF THE INVENTION

This invention relates to a packaging method and apparatus. Particularly, but not exclusively, the invention relates to a packaging method and apparatus for use in the packaging of foodstuffs including confectionery such as chocolate, candy or gum.

BACKGROUND TO THE INVENTION

One type of packaging machine that is commonly used in the food industry is known as a Vertical Form Fill Sealing (VFFS) machine. This type of machine constructs bags from a continuous roll of plastic film, fills the bags with their contents (which can either be solid, powder or liquid), and seals the bags once filled.

Typically, the roll of film is pre-printed with labeling on its exterior surface and sell by dates and production codes are printed on the film as the bags are passed through the machine. The film is passed through a series of rollers and fed towards a hollow conical feeder tube oriented vertically. As the centre of the film approaches the tube, the outer edges of the film are wrapped around the tube by so-called forming shoulders. A vertical seal is then applied to the overlapping edges of the film by a heated bar. A horizontal seal is then applied by another heated bar across the bottom edge of the tube of film. The contents of the bag are then dispensed through the feeder tube into the bag and the horizontal heated bar is then re-applied to simultaneously seal the top of the bag and the bottom of the next bag above. The filled bag is then cut from the tube ready for boxing and shipping as a sealed unit.

In some applications, a so-called "Euro-slot" or hanging aperture is provided for suspending the bags on display rails in retail outlets. The hanging aperture is punched or cut through the top of the bag just prior to the final sealing of the bag, when the bags are manufactured on their side. However, the throughput of the machine is hampered by the need to slow or stop the machine while the hanging apertures are being punched or cut. Consequently, production rates and manufacturing costs are adversely affected.

It is therefore an aim of the present invention to provide an improved packaging method and apparatus.

SUMMARY OF THE INVENTION

According to a first aspect of the present invention there is provided a packaging method comprising dispensing a material continuously from a roll, forming a plurality of packages from the material, filling each package with contents and sealing each package once filled, wherein a hanging aperture is created for each package, prior to it being formed into the package.

According to a second aspect of the present invention there is provided a packaging apparatus comprising a dispensing means for dispensing a material continuously from a roll, a forming means for constructing a plurality of packages from the material, a filling means for filling each package with contents and a sealing means for sealing each package once filled, wherein an aperture creation means is provided and is configured to create a hanging aperture for each package, prior to it being formed into a package.

By creating the hanging aperture prior to the material being formed into a package, it is possible to employ an aperture creation means that can operate while the material is passing through the apparatus in a steady continuous motion. This is because the hanging aperture can be applied, for example, to a continuous flat surface as the material is being dispensed (as opposed to being applied to a line of packages full of contents). Accordingly, the aperture creation means can be provided by a rotating wheel, for example.

Thus, the above aspects of the present invention enable a large number of packages to be processed in a given time since there is no need to slow or stop the machine in order for the hanging aperture to be created. Consequently, higher production speeds and lower manufacturing costs can be achieved.

The material may be at least partially folded or creased in or near to an area in which the aperture is to be created, prior to the creation of the hanging aperture. The material may be at least partially folded or creased so as to form a header region in the package. The material may be at least partially sealed along the fold or crease prior to or after creation of the hanging aperture.

The material may be plastic, paper, board, metal foil or fabric.

The hanging aperture may be constituted by a so-called "Euro-slot" or by a circular or elongate hole. For most applications, the hanging aperture will be provided towards the top of the package.

The packaging apparatus may be of the type known as vertical form fill sealing machines.

The packages produced may be in the form of pillow bags, doy packs, pouches, gusseted bags, strip pouches, block bottom packs or block top packs, amongst others.

The packages may be filled from an opening in a top or bottom surface or from an opening in a side surface.

The aperture creation means may be configured to cut or punch the material to form the aperture. Alternatively, it may be configured to apply heat and/or pressure to form the aperture in the material.

A folding means may be provided to fold the material prior to the creation of the hanging aperture. The aperture creation means may further comprise means for sealing the folded material together, for example, by heat and/or pressure.

In a particular embodiment, the aperture creation means may comprise a pair of wheels disposed side by side with their circumferences almost touching; one of the wheels having a cutter of the desired aperture shape projecting from its outer surface; the wheels being configured to rotate in opposite directions such that a roll of material fed between the two wheels will be stamped by the cutter every time the cutter passes before the adjacent wheel. The adjacent wheel may include a recess configured to accommodate the cutter every time the cutter passes before the adjacent wheel. At least one of the wheels may be heated.

It will be understood that the aperture creation means will be configured to create successive hanging apertures at predetermined spacings along the roll of material so as to provide an appropriate hanging aperture in the desired place on each successive package once formed.

BRIEF DESCRIPTION OF THE DRAWINGS

Embodiments of the various aspects of the invention will now be described, by way of example only, with reference to the accompanying drawings, in which.

DETAILED DESCRIPTION OF CERTAIN EMBODIMENTS

Figure 1:
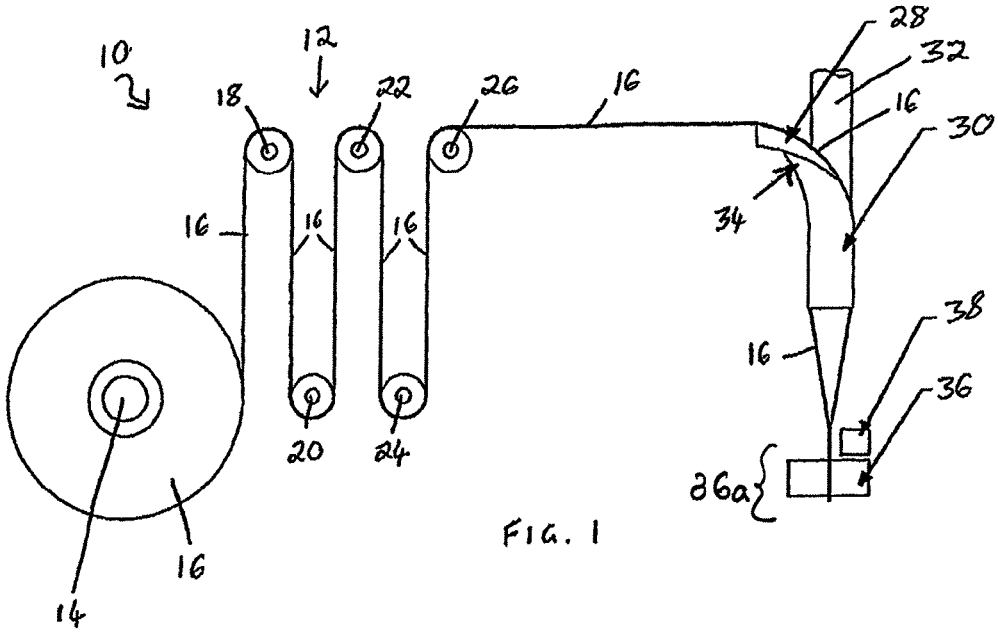
FIG. 1 illustrates a side schematic view of a known packaging apparatus.

With reference to FIG. 1, there is illustrated a known packaging apparatus 10 comprising a dispensing means 12 including a first horizontal roller 14. A roll of plastics material 16 is wrapped around the first roller 14 and is arranged to be dispensed therefrom. A second horizontal roller 18 is provided which is spaced both laterally and vertically from the roll of plastics material 16. A third horizontal roller 20 is provided with its axis on the same horizontal plane as the first roller 14, but spaced laterally from the second roller 18. A fourth horizontal roller 22 is provided with its axis on the same horizontal plane as the second roller 18, but spaced laterally from the third roller 20. A fifth horizontal roller 24 is provided with its axis on the same horizontal plane as the first and third rollers 14, 20, but spaced laterally from the fourth roller 22. A sixth horizontal roller 26 is provided with its axis on the same horizontal plane as the second and fourth rollers 18, 22, but spaced laterally from the fifth roller 24.

The roll of plastics material 16 is arranged to extend upwardly from the first roller 14, around the outer circumference of the second roller 18, downwardly from the second roller 18, around the outer circumference of the third roller 20, upwardly from the third roller 20, around the outer circumference of the fourth roller 22, downwardly from the fourth roller 22, around the outer circumference of the fifth roller 24, upwardly from the fifth roller 24, around the outer circumference of the sixth roller 26, and horizontally therefrom. It will be noted that, in use, the positions of the rollers 14, 18, 20, 22, 24, 26 can be adjusted so as to control the throughput of the plastics material 16.

The plastics material 16 then passes over a forming shoulder 28 which is constructed from a folded rectangular sheet 30 of metal arranged to wrap the sides of the plastics material 16 around a vertical feed tube 32. Thus, the sheet 30 comprises an upper portion 34 in which the opposite sides of the sheet 30 are gradually brought together and then to overlap slightly (not shown) so that one side of the material 16 overlaps with the other side. A vertical heated bar (not shown) is provided within the sheet 30 and is arranged to seal the overlapped sides of the material 16 together to form a tube of material 16.

A set of horizontal jaws 36 are provided below the feed tube 32 and are arranged to clamp onto the tube of material 16, to pull the tube of material 16 downwards by a pre-determined distance, and then to release the tube of material 16 and to re-position itself below the feed tube 32 and to repeat the above steps. The horizontal jaws 36 include at least one horizontal heated bar (not shown) which serves to seal the bottom of the tube of material 16 while it is being pulled downwards by the jaws 36.

A punch 38 is provided above the jaws 36 and is arranged for horizontal movement (i.e. at 90 degrees to the direction of travel of the tube of material 16) in order to punch a hanging aperture 39 through the seal created by the jaws 36 at the bottom of the tube of material 16, after the jaws have released the tube of material 16.

The feed tube 32 is a hollow cylindrical tube which is disposed with its lower end within the sheet 30 and within the tube of material 16 once formed as described above.

In use, the contents to be packaged are dispensed through the feed tube 32 into a bag 40 created from the material 16, while (or after) the jaws 36 are sealing the bottom of the tube of material 16. It will be understood that the jaws 36 will simultaneously seal the top of one bag 40 and the bottom of the next bag above. The filled bags 40 will then be cut from the tube of the material 16 by cutting means 36*a*, ready for boxing and shipping as a sealed unit.

In the above known packaging apparatus 10, the hanging aperture 39 is created after the bottom of the tube of material 16 has been sealed. In order for this to be done, there is a necessary delay between the jaws 36 pulling the tube of material 16 through the apparatus 10 and the punch 38 operating at 90 degrees to the direction of travel of the tube of material 16. Accordingly, the progress of the tube of material 16 must be slowed or stopped to allow the hanging aperture 39 to be created and this limits the throughput of the apparatus 10.

Figure 2:
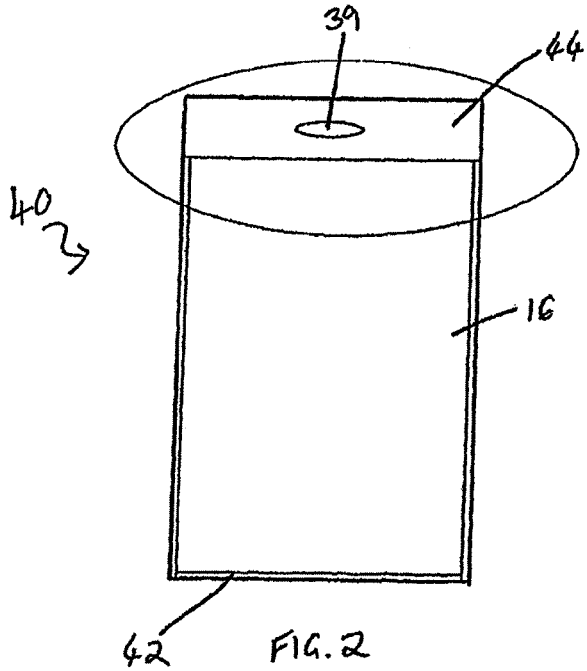
FIG. 2 illustrates a front view of a typical package produced by the apparatus of FIG. 1.

An example of a bag 40 produced by the above apparatus 10 is shown in FIG. 2. Thus, it is made from the material 16 and is of a generally rectangular form with a lower seal 42 along its base and an upper seal 44 along its top. A longitudinal seal (not shown) is also provided on its rear surface. The hanging aperture 39 is provided in the centre of the upper seal 44 and is in the form of a transversely elongated elliptical hole.

It will be understood that the cutting means 36*a* can either be configured to severe the bags 40 from the tube of material 16 with the hanging aperture 39 provided at the base of each bag 40 or the top of each bag 40 depending on whether the cut is made before or after the hanging aperture 39 has passed the blade of the cutting means.

Figure 3:
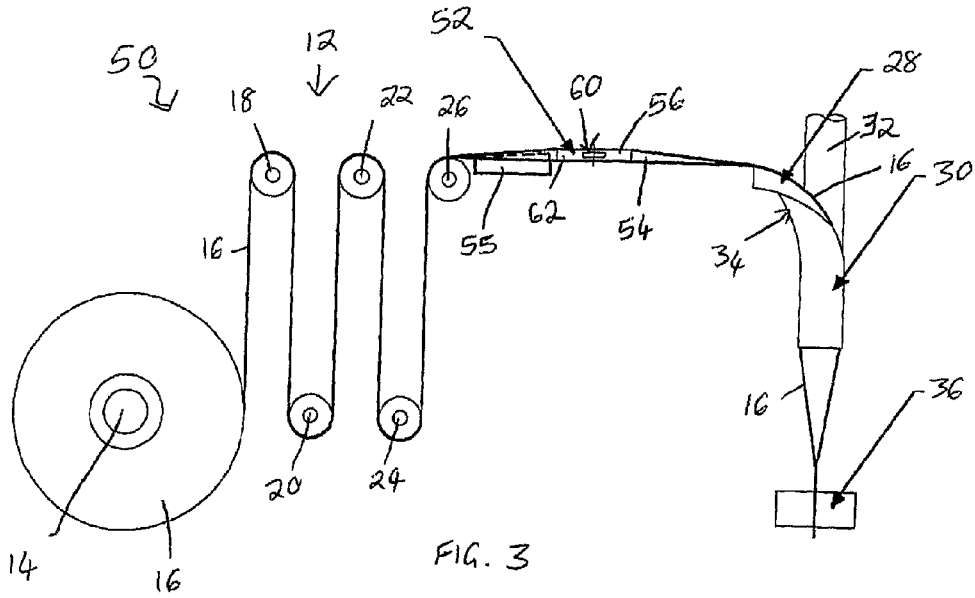
FIG. 3 illustrates a side schematic view of a packaging apparatus according to an embodiment of the present invention.

FIG. 3 illustrates a packaging apparatus 50 according to an embodiment of the present invention. The basic structure of the apparatus 50 is similar to that of the known apparatus 10 and so like reference numerals will be employed where appropriate. In fact, the main difference between the known apparatus 10 and the present apparatus 50 is that the punch 38 has been removed and replaced by an aperture creation means 52 provided between the dispensing means 12 and the forming shoulder 28.

Figure 4:
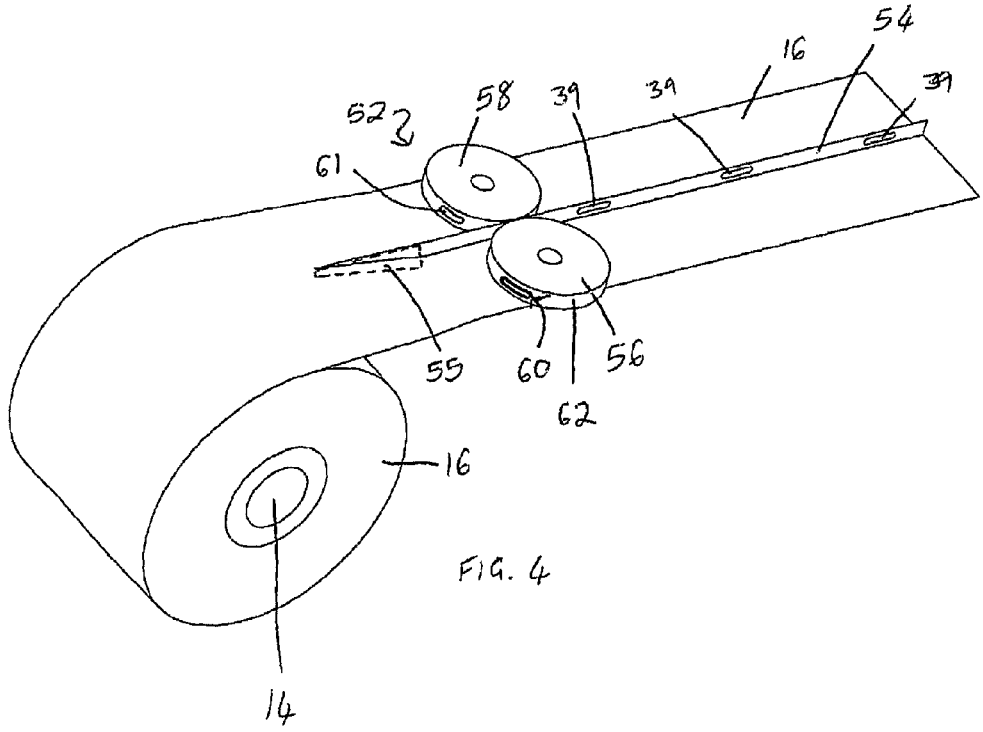
FIG. 4 illustrates a perspective view of a portion of the apparatus of FIG. 3 showing the creation of hanging apertures on the initial roll of material.
Figure 5A:
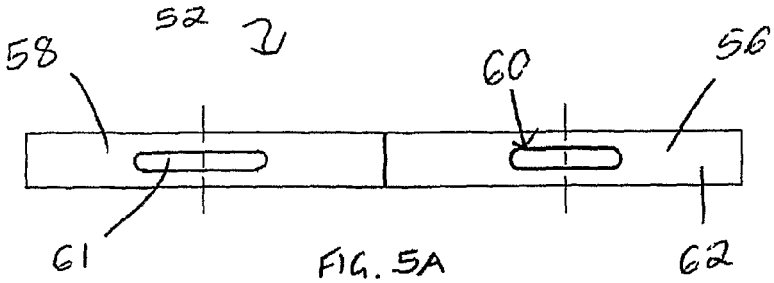
FIG. 5A shows a side view of the aperture creation means of FIGS. 3 and 4.
Figure 5B:
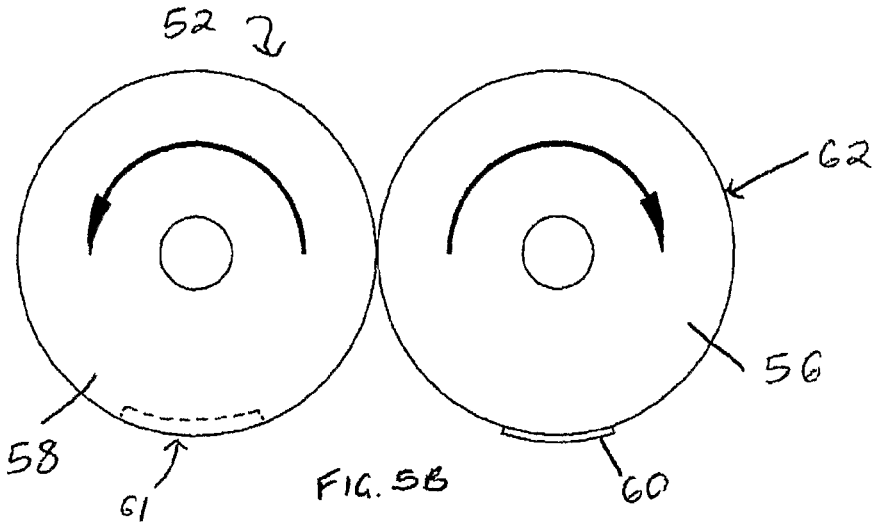
FIG. 5B shows a top view of the aperture creation means of FIGS. 3 and 4.

The structure and operation of the aperture creation means 52 is shown in more detail in FIGS. 4, 5A and 5B. In particular, FIG. 4 shows a simplified version of the dispensing means 12 in which the roll of material 16 is pulled in a horizontal direction, directly from the first roller 14, without passing over the second to sixth rollers 18, 20, 22, 24, 26.

A fold 54 is created along the centre of the material 16 by a folding means in the form of an upstanding elongated finger 55 which is positioned in the centre of the material 16, immediately preceding but on the opposite side of the material 16 to the aperture creation means 52. The finger 55 is arranged to lift the centre of the material 16 sufficiently so as to form a fold 54 down the centre of the material 16. If desired, an upturned "v" or "u" shaped folding guide (not shown) can be provided over the finger 55 and the material 16, so as to contour the centre of the material 16 in the correct manner, prior to the fold 54 being permanently sealed by the aperture creation means, as will be described below.

The aperture creation means 52 comprises a first wheel 56 which is disposed with its circumference adjacent to and almost touching that of a second wheel 58. The first wheel 56 includes a cutter 60 in the shape of the hanging aperture 39 (i.e. a transversely elongated elliptical hole) projecting from its outer circumferential surface 62. In this embodiment, the second wheel 58 has an aperture 61 which is of a complementary shape to, and able to receive, the cutter 60 when both wheels 56, 58 are rotating.

Additionally, if desired, the aperture 61 may contain a punch (not shown) configured to push out any waste material 16 from the aperture 61 when the second wheel 58 has been rotated away from the cutter 60.

In use, the first and second wheels 56, 58 are configured to rotate in opposite directions (as illustrated in FIG. 5B) such that when the fold 54 is fed between the first and second wheels 54, 56, it is stamped by the cutter 60 every time the cutter 60 passes before the second wheel 58. Accordingly, the cutter 60 will create successive hanging apertures 39 in the fold 54 at pre-determined spacings along the roll of material 16 so as to provide an appropriate hanging aperture 39 in the desired place on each successive bag 40 once formed.

In this particular embodiment, the first wheel 56 is heated to 50° C. and the second wheel 58 is heated to 150° C. so as to heat seal the fold 54 together as it passes through the aperture creation means 52.

It should be noted that FIG. 4 actually illustrates the underneath view of the material 16 since, in practice, the hanging apertures 39 must be provided on the outer surface of the material 16 as it is being formed into a tube of material 16 by the forming shoulder 28. It should also be noted that in this embodiment, the hanging apertures 39 are formed along a vertical edge of the tube of material 16, as viewed in FIG. 3.

An advantage of the above embodiment of the invention is that that the hanging apertures 39 are provided by a simple mechanism which does not require the throughput of the material 16 to be slowed or stopped in order to create the hanging apertures 39. Thus, the apparatus 50 can be run in a continuous, fully operational capacity.

Typically machines in the form of the known apparatus 10 of FIG. 1 (i.e. those configured with a punch 38 provided to create the hanging aperture 39 between the feed tube 32 and the jaws 36), run at 75 bags per minute. However, the Applicants have found that with the apparatus 50 according to the above described embodiment of the invention (i.e. with the hanging aperture 39 created prior to the forming of the bag 40 by the forming shoulder 28), a throughput of approximately 125 bags per minute can be achieved. Furthermore, with the aperture creation means 52 being provided in registration with the continuous motion of the material 16 through the machine, it is possible that the motion of the jaws 36 could be increased further to increase the overall speed of the apparatus 50.

It will be understood that the temperatures of the first and second wheels 56, 58 should be selected to provide an appropriate seal for the material 16 employed.

In alternative embodiments of the present invention, an ultrasonic seal may be provided along the fold 54.

It will be appreciated by persons skilled in the art that various modifications may be made to the above-described embodiments without departing from the scope of the present invention. For example, whilst the above discussion has been primarily concerned with a packaging method and apparatus for use in the food and drink industry, the invention is equally applicable to other packaging applications.

The invention claimed is:

1. A packaging method comprising:

dispensing a material continuously from a roll;

forming a plurality of packages from the material by passing material over a forming shoulder to form the material into a tube;

filling each package with contents; and sealing each package once filled; and separating each said filled package from said roll;

wherein a hanging aperture is created for each package in the material, prior to the material being passed over the forming shoulder.

2. The packaging method according to claim 1 wherein the hanging aperture is created after the material has been dispensed.

3. The packaging method according to claim 1 wherein the material is at least partially folded or creased in or near to an area in which the aperture is to be created, prior to the creation of the hanging aperture.

4. The packaging method according to claim 3 wherein the material is at least partially folded or creased so as to form a header region in the package.

5. The packaging method according to claim 3 wherein the material is at least partially sealed along the fold or crease prior to or after creation of the hanging aperture.

6. The packaging method according to claim 5 wherein the material comprises plastic, paper, board, metal foil or fabric.

7. The packaging method according to claim 1 wherein the hanging aperture is constituted by a Euro-slot or by a circular or elongate hole.

8. The packaging method according to claim 1 wherein the hanging aperture is provided towards the top of the package.

9. The packaging method according to claim 1 wherein the packages produced are in the form of pillow bags, doy packs, pouches, gusseted bags, strip pouches, block bottom packs or block top packs.

10. The packaging method according to claim 1 wherein the packages are filled from an opening in a side surface.

11. A packaging apparatus comprising:

a dispenser for dispensing a material continuously from a roll;

a forming shoulder for constructing a plurality of packages from the dispensed material;

a filling tube for filling each package with contents;

a sealing jaws for sealing each package once filled; and a cutting device for separating each package from the roll of material; and wherein an aperture creation means is positioned between said dispenser and said forming shoulder to create a hanging aperture for each package, prior to said material being formed into a package.

12. The packaging apparatus according to claim 11 wherein the aperture creation means is provided by a rotating wheel.

13. The packaging apparatus according to claim 11 configured as a vertical form fill sealing machine.

14. The packaging apparatus according to claim 11 wherein the aperture creation means is configured to cut or punch the material to form the aperture.

15. The packaging apparatus according to claim 11 wherein the aperture creation means is configured to apply heat and/or pressure to form the aperture in the material.

16. The packaging apparatus according to claim 11 wherein a folding finger is provided to fold the material prior to the creation of the hanging aperture.

17. The packaging apparatus according to claim 16 wherein the aperture creation means further provides for sealing the folded material together by heat and/or pressure.

18. The packaging apparatus according to claim 11 wherein the aperture creation means comprises a pair of wheels disposed side by side with their circumferences almost touching; one of the wheels having a cutter of the desired aperture shape projecting from its outer surface; the wheels being configured to rotate in opposite directions such that the roll of material fed between the two wheels will be stamped by the cutter every time the cutter passes before the adjacent wheel.

19. The packaging apparatus according to claim 18 wherein the adjacent wheel includes a recess configured to accommodate the cutter every time the cutter passes before the adjacent wheel.

20. The packaging apparatus according to claim 18 wherein at least one of the wheels is heated.

21. The packaging apparatus according to claim 11 wherein the aperture creation means is configured to create successive hanging apertures at pre-determined spacings along the roll of material so as to provide an appropriate hanging aperture in the desired place on each successive package once formed.

* * * * *